United States Patent [19]

Immekus

[11] 4,341,553

[45] Jul. 27, 1982

[54] METHOD OF, AND CUPOLA FURNACE FOR, THE INTRODUCTION OF TREATMENT AGENTS INTO CUPOLA IRON MELTS

[75] Inventor: Karl Immekus, Kaarst, Fed. Rep. of Germany

[73] Assignee: Gesellschaft für Hüttenwerksanlagen mbH, Düsseldorf, Fed. Rep. of Germany

[21] Appl. No.: 173,696

[22] Filed: Jul. 30, 1980

[30] Foreign Application Priority Data

Aug. 9, 1979 [DE] Fed. Rep. of Germany ..... 2932235

[51] Int. Cl.[3] ..... C22C 33/08

[52] U.S. Cl. ..... 75/53; 75/130 R; 75/130 B; 75/130 BB

[58] Field of Search ..... 75/53, 61, 130 R, 130 B, 75/130 BB

[56] References Cited

U.S. PATENT DOCUMENTS

| | | | |
|---|---|---|---|
| 3,231,371 | 1/1966 | Schaeffer | 75/130 R |
| 3,802,680 | 4/1974 | Anders | 75/53 |
| 3,833,361 | 9/1974 | Kusaka | 75/130 B |
| 3,880,411 | 4/1975 | Voronova | 75/130 BB |
| 3,955,974 | 5/1976 | Alt | 75/130 B |
| 3,998,625 | 12/1976 | Koros | 75/53 |
| 4,180,396 | 12/1979 | Caspers | 75/130 R |

*Primary Examiner*—P. D. Rosenberg

*Attorney, Agent, or Firm*—Toren, McGeady & Stanger

[57] ABSTRACT

A cupola furnace has a hearth 1 with tuyeres 2, a floor 3 and a tapping duct 4 leading to a forehearth 5. To enable treatment agents to be introduced into the melt in the furnace below the surface of the melt, the furnace is additionally provided with a lance 17 which extends through lining brickwork of the furnace into a sump 15 in the floor of the furnace. The lance 17 may be connected to a hot blast ring main which supplies the tuyeres 2.

7 Claims, 4 Drawing Figures

METHOD OF, AND CUPOLA FURNACE FOR, THE INTRODUCTION OF TREATMENT AGENTS INTO CUPOLA IRON MELTS

This invention relates to methods of and to a cupola furnace for the introduction of pulverulent, gaseous or liquid treatment agents into cupola metal melts.

Cupola metal melts usually require metallurgical treatment, for example desulphurization, de-oxidation and alloying.

Desulphurizing agents such as calcium carbide and lime dust or alloying agents such as carbon, silicon, manganese and chromium are added to the molten cast iron usually in an iron trough, a forehearth or in a casting or transporting ladle. It is also known to introduce desulphurizing and alloying agents as charge constituents into the melt while it is in the cupola furnace.

Furthermore, in the production of cast iron comprising nodular graphite, it is known to introduce the magnesium necessary for spherulitization of the carbon into a ladle melt with the assistance of a carrier gas and an injector or by means of a sealing cone.

Furthermore, cast iron is frequently inoculated before pouring, in order to improve the grey iron solidification and to suppress the so-called white streaking, that is the occurrence of ledeburite in the edge region of the cast ingot. The inoculating agent most commonly employed is pulverulent ferrosilicon with additives such as calcium and aluminium. Inoculation is usually carried out in a ladle by the introduction of the inoculating agent into the ladle, during tapping, into the molten metal jet flowing from the furnace into the ladle, or by immersion and by blowing-in with the help of a lance.

Finally, methods are also known, in which a cast iron melt is refined by means of a blowing or smoking lance in a ladle, in order to adjust specific contents of carbon, silicon, manganese or phosphorus.

The aforementioned methods of introducing treatment agents are all, however, accompanied by the common disadvantage that during their introduction, the treatment agents come into contact with the oxygen of the atmosphere to a greater or lesser extent, if the introduction is not carried out under vacuum or under a shielding gas. Since the treatment agents at the temperature of the molten cast iron usually possess a very high oxygen affinity, correspondingly high slagging of the treatment agents occurs during their introduction. This results not only in undesired deviations from the required cast iron analysis, but in addition in considerable slagging losses of the treatment agents which are usually very expensive. Nevertheless, in many cases the use of a vacuum or feeding under a protective gas is not justified, since the cost of the equipment required for this purpose is considerable.

The object of the present invention is to overcome the aforementioned disadvantages and in particular to provide a method which enables treatment agents to be introduced into a cupola cast iron melt with low burn-up of the agents, and preferably under reducing conditions, or to refine the cast iron melt under especially favourable conditions.

To this end, according to one aspect of this invention, we provide a method of introducing a treatment agent into a cupola iron melt wherein the treatment agent is introduced directly into the iron melt while the melt is in the cupola furnace.

In the melt in the furnace, predominantly reducing conditions obtain and simultaneously a good and thorough mixing is assured. Since, in the cupola furnace, the melt zone extends on either side of the plane of blowing tuyeres and the iron droplets evolving in the melt zone accumulate at the foot of the coke column or on the cupola furnace floor, before they leave the furnace hearth through the tapping duct, the treatment agent is preferably introduced, in the method of this invention, into an iron sump situated in the furnace floor or into the iron melt flowing through the tapping duct which usually leads to a forehearth. This may be done pneumatically, for example by means of air pressure or mechanically.

Gaseous treatment agents may for example, be introduced into the iron sump or into the tapping duct flow through a porous plug mounted on the end of the lance, whereas solid or pulverulent treatment agents are preferably introduced into the liquid cast iron by means of a carrier gas.

Alternatively, however, pulverulent treatment agents may be introduced into the liquid cast iron by means of a reducing burner flame.

In all the methods mentioned, the treatment substances hardly come into contact with oxygen, once they are heated by the furnace, so that the burn-up losses are minimal.

In addition, the liquid cast iron leaves the cupola furnace together with the furnace slag, so that iron and slag can continue to react in a furnace forehearth or in a casting ladle. A clear separation between metal and slag is then assured without an additional expenditure of time, accompanied by a temperature loss due to unavoidable heat radiation, being necessary for this purpose.

In contrast to the known methods, in which the treatment agent is not added to the molten iron until after it has left the cupola furnace, that is at the earliest in a forehearth or in a teaming ladle, the reactions between the treatment agent and the iron in the method in accordance with this invention are already well advanced when the iron and the slag leave the cupola furnace. The forming of slag is, therefore, very rapidly completed after leaving the cuplola furnace, and the molten iron also becomes slag-free with corresponding rapidity.

A further substantial advantage of the method in accordance with this invention consists in the fact that the high turbulance of the melt during tapping ensures excellent, thorough mixing of metal, slag and the treatment agent. The consequence of this is a rapid uniformity of the melt and a slag that has reacted with the iron to the greatest possible extent. The method in accordance with this invention may be so arranged that the iron is ready for pouring as soon as it leaves the cupola furnace, or at least very shortly thereafter. This is of particular advantage especially for melts treated with oxidation-sensitive agents, especially since the slag accompanying the iron covers the iron melt and thus protects it from the atmosphere. There is thus no risk of adverse influence upon the treatment agent due to the slag layer floating on the iron, as is the case with the conventional introduction of treatment agents. In this manner, for example when producing cast iron comprising nodular graphite by the introduction of magnesium or cerium by the method in accordance with the present invention, reforming of spherulites due to the oxidising of the magnesium or cerium does not occur.

Also, the melt undergoes far smaller temperature losses, because after it has left the cupola furnace it remains substantially at rest, whereas in the known treatment methods it must undergo a more or less pronounced stirring action. Also, the time required between tapping and casting is reduced.

The invention also consists according to another of its aspects in a cupola furnace for carrying out the method characterized in that the furnace has a lance penetrating through brickwork lining of the furnace into a furnace hearth or tapping duct below the level of the melt, when the furnace is in operation, and means for introducing a treatment agent through the lance into the melt. Preferably the tapping duct leads to a forehearth of the furnace which has molten iron and slag outlets.

Preferably, the lance enters in the furnace in a sump in the furnace floor. Alternatively, the lance may also lead into the tapping duct, preferably in the region of the inlet to the duct.

In order to overcome the internal pressure of the cupola furnace without excessively large energy consumption, the lance may be connected via a blower to a hot air ring main which supplies tuyeres of the furnace. In this case, the blower only needs to bring the hot air, functioning as carrier gas and already under pressure, up to a slightly higher pressure. This variant can, however, only be used when there is no risk of the hot air blast oxidizing the treatment agent too much or when the cast iron melt is to be refined.

The sump may have its own additional tapping duct to enable the furnace hearth to be completely emptied when required.

Some examples of methods and of furnaces in accordance with the invention will now be described with reference to the accompanying drawings in which.

Figure 1:
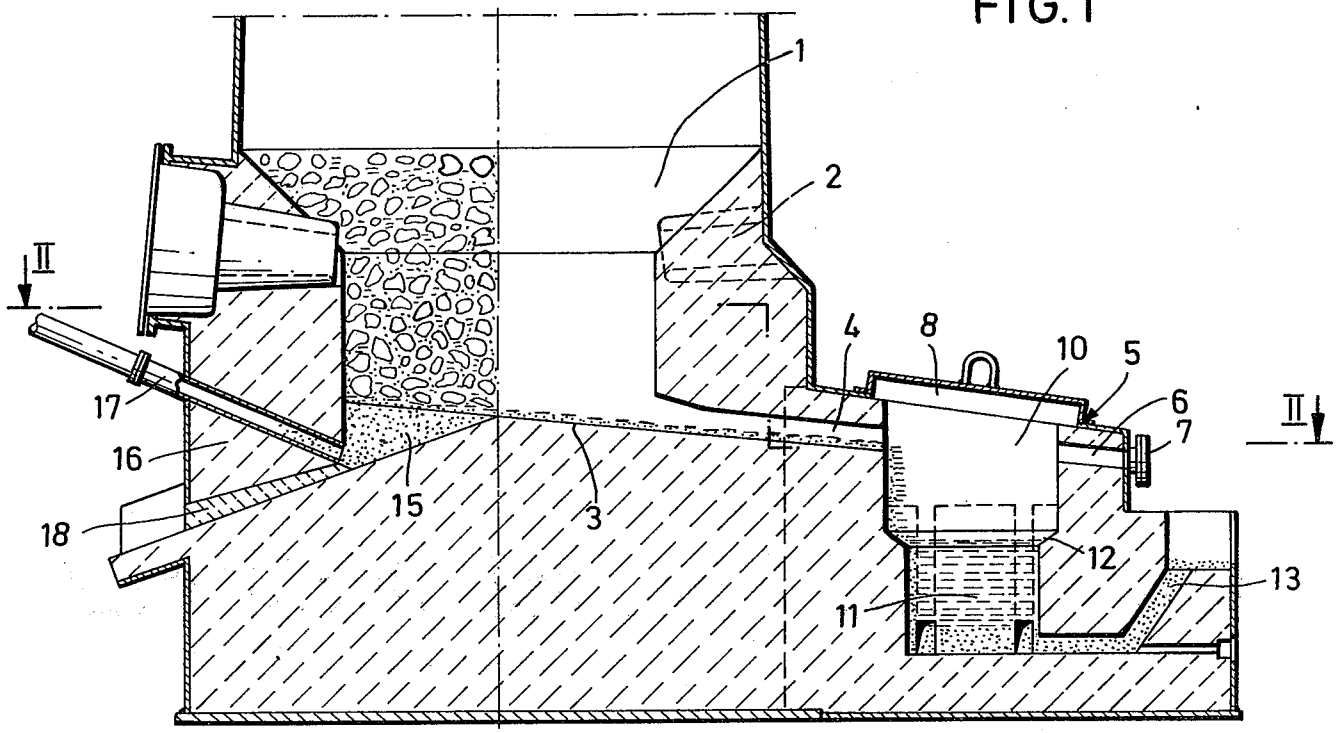
FIG. 1 is a vertical section through the hearth of a first example of a cupola furnace comprising a lance penetrating through the brickwork lining of the furnace in the region of a sump on the floor of the lining.
Figure 2:
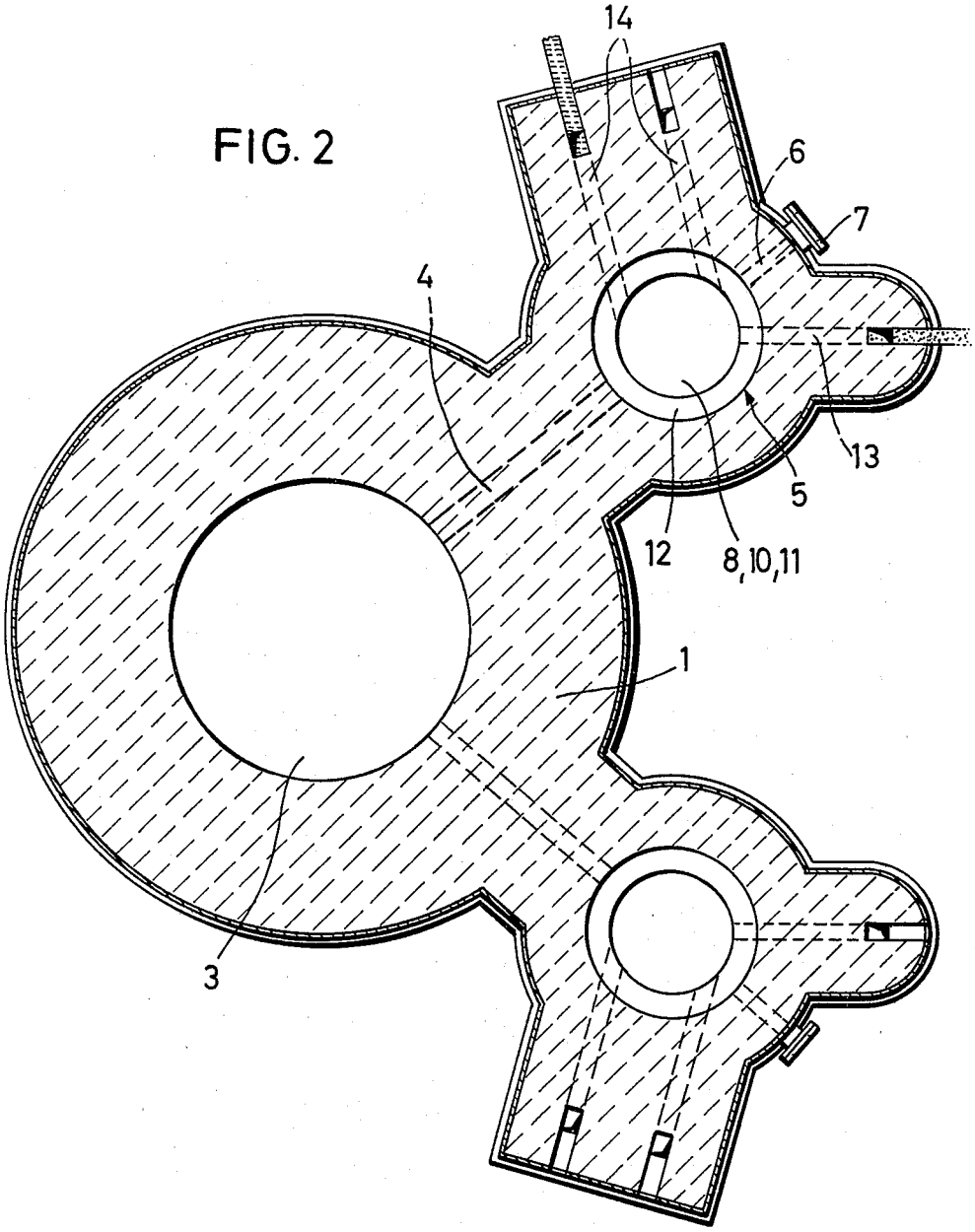
FIG. 2 is a horizontal section along the line II—II in FIG. 1.

With reference to FIGS. 1 and 2, a hearth 1 of a cupola furnace has, as usual, a number of blast tuyeres 2 disposed in a circle around a periphery at a distance from an inclined furnace floor 3. Forming a direct extension of the furnace floor 3, two tapping ducts 4 extend at an angle to each other each to a forehearth 5. The forehearths 5 are of identical construction to each other.

Each tapping duct 4 leads into the upper part of the forehearth 5 and is in alignment with a diametrically opposite observation duct 6 comprising a viewing hole 7, through which the forehearth and interior of the furnace can be observed. To make possible repair and maintenance work, the forehearth has a removable, gas-tight cover 8 on the inclined upper side of the forehearth.

The internal space of the forehearth comprises an upper slag section 10 of larger cross-section, a lower iron section 11 of smaller cross-section, and a conical transition 12 between the two sections of the forehearth. From the iron section 11, an iron siphon 13 leads from immediately above the floor of the forehearth. At an angle to the iron siphon 13, two slag siphons 14 lead from the iron section 11 parallel to each other and at the same level as each other.

To enable the introduction of the treatment agents in accordance with the method of this invention to take place, the furnace floor 3 has a depression 15, into which a lance 17, passing through the furnace hearth lining brickwork 16, leads. The depression 15 also has at its lowest point, an additional tapping duct 18, which is always closed during operation of the furnace, but which makes possible complete emptying of the hearth.

Figure 3:
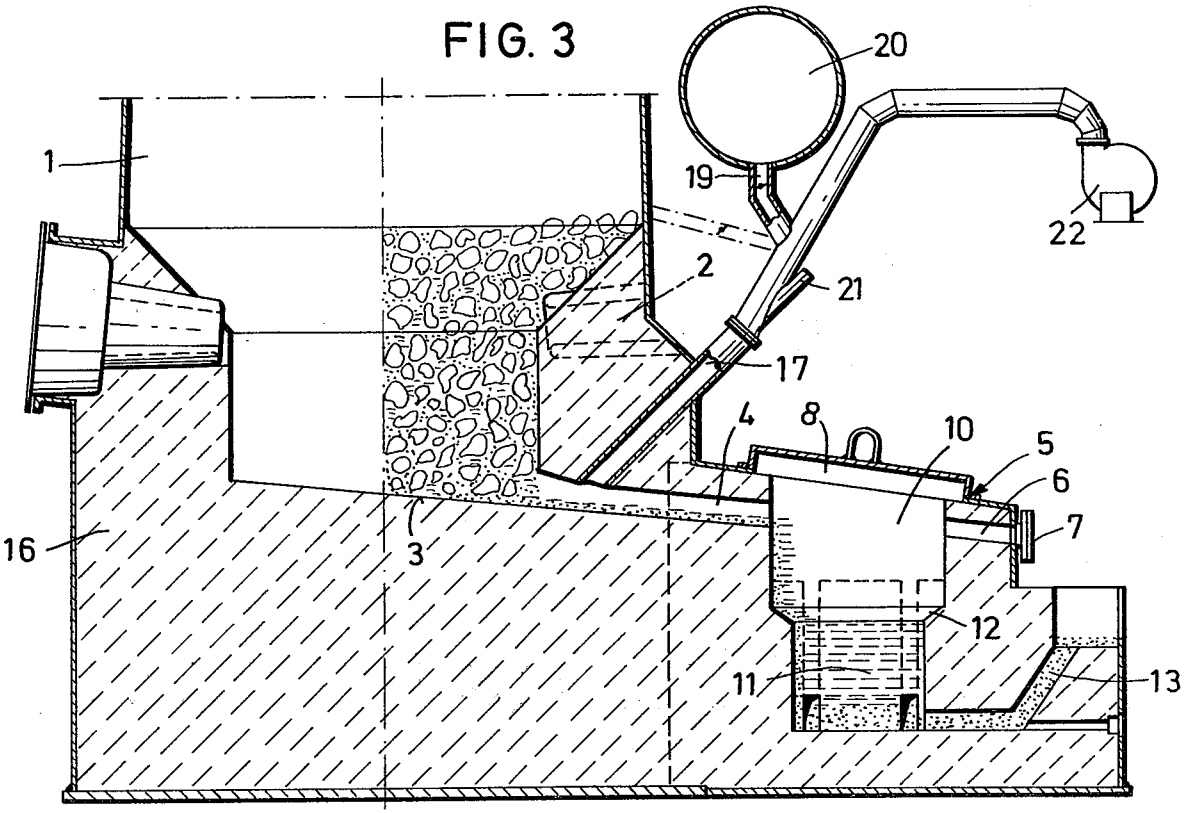
FIG. 3 is a vertical section similar to FIG. 1 but through a second example of a cupola furnace hearth with a lance leading into the tapping duct of the furnace; and, FIG. 4 is a section similar to FIG. 2, but of the furnace shown in FIG. 3.
Figure 4:
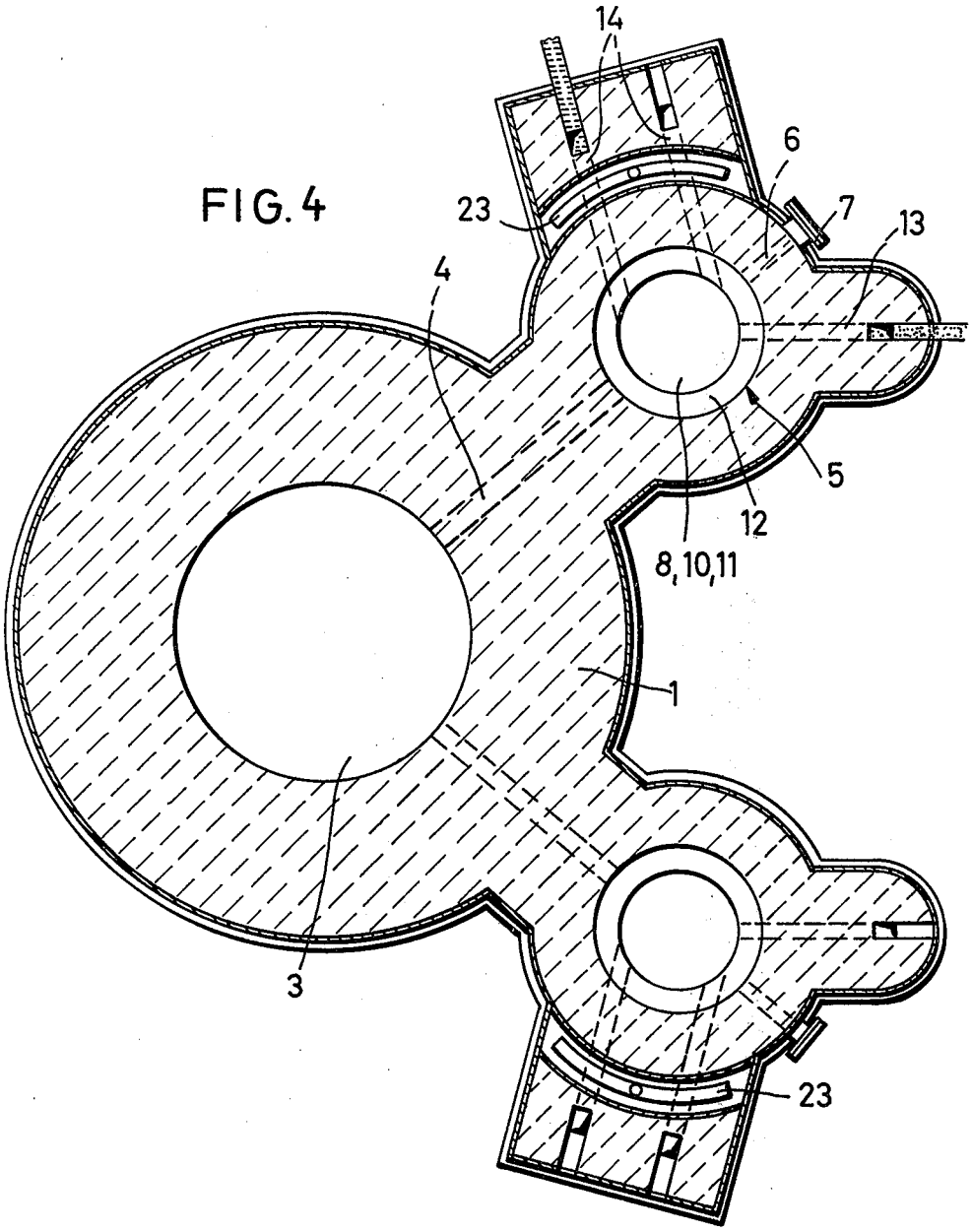

The furnace hearth in the example illustrated in FIGS. 3 and 4 differs from that illustrated in FIGS. 1 and 2 only in that the furnace floor is of conventional construction and a lance 17 for introducing the treatment agents leads into the inlet portion of each tapping duct 4. Also, the lance is connected by a branch line 19 to a hot blast ring main 20 and is equipped with a viewing window 21 for observing the tapping duct 4. A blower 22 compresses air coming from the hot blast ring main 20 to a pressure which overcomes the internal pressure of the furnace. Also, the forehearths and their slag siphons 14 have a water cooling system 23, which considerably increases their service life.

In both the illustrated examples of the cupola furnace in accordance with the invention, the treatment agents are introduced via the lance 17 either into the depression 15 or into the tapping ducts 4 directly into the furnace melt mixed with the slag, without coming into contact with oxygen of the atmosphere. The yield of oxygen-affinitive treatment agents or alloying additives is therefore very high. Also, with a low dwell time in the forehearths, there is obtained at the siphons 13 a cast iron adjusted to the required finished analysis and which can be already inoculated, so that it can be cast immediately, that is without any ladle treatment and without appreciable temperature losses.

I claim:

1. A method for introducing treating agents into a melt in a cupola furnace having tapping ducts and an obliquely extending furnace floor comprising introducing the treating agent, under reducing atmosphere, into an iron sump situated in a depression in the furnace floor and being directly connected by said floor with at least one tapping duct.

2. A method for introducing treating agents with a lance into a melt in a cupola furnace having a tapping duct comprising introducing the treating agent, under reducing atmosphere, into the melt as the melt flows through the tapping duct.

3. The method of claim 1 or 2 wherein said treatment agent is introduced into said melt by air pressure.

4. The method of claim 1 or 2 wherein said treatment agent is introduced into said melt by mechanical means.

5. The method of claim 1 or 2 wherein said treatment agent is gaseous and is introduced into said melt through a porous plug.

6. The method of claim 1 or 2 wherein said treatment agent is introduced into said melt entrained in a stream of a carrier gas.

7. The method of claim 1 or 2 wherein said carrier gas is produced with the assistance of a reducing burner flame.

* * * * *